US009451674B1

(12) United States Patent
Kong et al.

(10) Patent No.: US 9,451,674 B1
(45) Date of Patent: Sep. 20, 2016

(54) INVENTORY LOCATION ILLUMINATION FOR DESIGNATING OPERATION PATH

(71) Applicant: Amazon Technologies, Inc., Reno, NV (US)

(72) Inventors: Cheuk-Man Kong, Toronto (CA); Mohan Krishna Rao, Mississauga (CA); Morley Duncan Abbott, Toronto (CA); Balasubramaneyam Maniymaran, Scarborough (CA)

(73) Assignee: Amazon Technologies, Inc., Reno, NV (US)

( * ) Notice: Subject to any disclaimer, the term of this patent is extended or adjusted under 35 U.S.C. 154(b) by 259 days.

(21) Appl. No.: 14/108,250

(22) Filed: Dec. 16, 2013

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 37/02*** | (2006.01) |

(52) U.S. Cl.
CPC ..... *H05B 37/0209* (2013.01)

(58) Field of Classification Search
USPC ..... 315/149–159
See application file for complete search history.

(56) References Cited

U.S. PATENT DOCUMENTS

| | | | |
|---|---|---|---|
| 4,958,292 | A | 9/1990 | Kaneko et al. |
| 5,270,157 | A | 12/1993 | Bell et al. |
| 5,385,243 | A | 1/1995 | Jackson et al. |
| 5,395,206 | A | 3/1995 | Cerny, Jr. |
| 5,646,616 | A | 7/1997 | Komatsu |
| 5,781,443 | A | 7/1998 | Street et al. |
| 5,805,456 | A | 9/1998 | Higham et al. |
| 5,812,986 | A | 9/1998 | Danelski |
| 5,844,806 | A | 12/1998 | Shibano |
| 5,875,434 | A | 2/1999 | Matsuoka et al. |
| 5,877,962 | A | 3/1999 | Radcliffe |

(Continued)

FOREIGN PATENT DOCUMENTS

| | | |
|---|---|---|
| EP | 732278 | 9/1996 |
| JP | 07-101515 | 4/1995 |

(Continued)

OTHER PUBLICATIONS

Intelligrated, "Real Time Solutions Trak3 XD and Trak3 XL", Sep. 9, 2013, 1 page.

(Continued)

*Primary Examiner* — Brandon S Cole
(74) *Attorney, Agent, or Firm* — Robert C. Kowert; Meyertons, Hood, Kivlin, Kowert & Goetzel, P.C.

(57) ABSTRACT

Systems, methods and media for illuminating locations where operations are to be performed are disclosed. A set of locations where an operation is to be performed by an agent may be determined by a control system. A particular illumination pattern of numerous illumination patterns may be assigned to an agent by the control system. Illumination patterns may be colors, shapes, blink rates or any combination thereof for example. The control system may send instructions to illumination devices that correspond to the set of locations to designate all of the locations in the set of locations with the particular illumination pattern assigned to the agent such that the agent is visually aware of location to traverse. Distinct agents may each be assigned distinct illumination patterns such that the agents may operate in the same area without confusion of which agent should perform the operation at a location.

20 Claims, 8 Drawing Sheets

(56) References Cited

U.S. PATENT DOCUMENTS

| | | | | |
|---|---|---|---|---|
| 5,934,413 | A | 8/1999 | Konig et al. | |
| 5,963,134 | A | 10/1999 | Bowers et al. | |
| 5,970,471 | A | 10/1999 | Hill | |
| 5,977,501 | A | 11/1999 | Werkheiser et al. | |
| 6,061,887 | A | 5/2000 | Kawasaki et al. | |
| 6,154,771 | A | 11/2000 | Rangan et al. | |
| 6,273,338 | B1 | 8/2001 | White | |
| 6,308,109 | B1 | 10/2001 | Yuyama et al. | |
| 6,339,764 | B1 | 1/2002 | Livesay et al. | |
| 6,425,226 | B1 | 7/2002 | Kirschner | |
| 6,541,100 | B1 | 4/2003 | Williams et al. | |
| 6,548,967 | B1 * | 4/2003 | Dowling | G06Q 30/0201 315/307 |
| 6,566,024 | B1 | 5/2003 | Bourdelais et al. | |
| 6,622,127 | B1 | 9/2003 | Klots et al. | |
| 6,650,225 | B2 | 11/2003 | Bastian et al. | |
| 6,736,316 | B2 | 5/2004 | Neumark | |
| 6,762,382 | B1 | 7/2004 | Danelski | |
| 6,775,588 | B1 | 8/2004 | Peck | |
| 6,876,902 | B2 | 4/2005 | Nikolich | |
| 6,969,092 | B2 | 11/2005 | MacWilliams et al. | |
| 7,031,801 | B1 | 4/2006 | Hodge et al. | |
| 7,055,741 | B2 | 6/2006 | Bong et al. | |
| 7,084,365 | B2 | 8/2006 | Whitnable | |
| 7,331,471 | B1 | 2/2008 | Shakes et al. | |
| 7,504,949 | B1 | 3/2009 | Rouaix et al. | |
| 7,516,848 | B1 | 4/2009 | Shakes et al. | |
| 7,941,244 | B2 | 5/2011 | Somin et al. | |
| 7,984,809 | B1 | 7/2011 | Ramey et al. | |
| 8,244,603 | B1 | 8/2012 | Tang et al. | |
| 8,836,222 | B1 * | 9/2014 | Patrick | H05B 37/0227 315/154 |
| 2002/0070846 | A1 | 6/2002 | Bastian et al. | |
| 2002/0133387 | A1 | 9/2002 | Wilson et al. | |
| 2002/0194051 | A1 | 12/2002 | Hall et al. | |
| 2003/0004816 | A1 | 1/2003 | Byers, Jr. et al. | |
| 2003/0009392 | A1 | 1/2003 | Perkowski | |
| 2003/0233165 | A1 | 12/2003 | Hein et al. | |
| 2004/0035927 | A1 | 2/2004 | Neumark | |
| 2004/0160332 | A1 | 8/2004 | Perry | |
| 2005/0043850 | A1 | 2/2005 | Stevens et al. | |
| 2005/0067318 | A1 | 3/2005 | Cesario | |
| 2005/0149226 | A1 | 7/2005 | Stevens et al. | |
| 2009/0081008 | A1 | 3/2009 | Somin et al. | |
| 2012/0133303 | A1 * | 5/2012 | Campbell | H04W 4/04 315/312 |
| 2013/0026941 | A1 * | 1/2013 | Ganick | G01C 21/206 315/224 |
| 2013/0026945 | A1 * | 1/2013 | Ganick | H05B 37/0272 315/246 |
| 2014/0354161 | A1 * | 12/2014 | Aggarwal | H05B 37/0245 315/153 |

FOREIGN PATENT DOCUMENTS

| | | |
|---|---|---|
| JP | 80-81025 | 3/1996 |
| JP | 08-119419 | 5/1996 |
| JP | 2000-306062 | 11/2000 |
| JP | 2005-22815 | 1/2005 |

OTHER PUBLICATIONS

Intelligrated, "Latest News", Sep. 9, 2013, 1 page.

Lightning Pick Technologies, "The Best-in-Class Pick to Light System", Sep. 9, 2013, pp. 1-2.

Thomasnet News, "Pick-to-Light Hardware Features Multicolor Interface", Sep. 9, 2013, pp. 1-3.

"Book Collector Book Inventory Software," Collectorz.com Book Collector, n.d., <http://www.collectorz.com/book/book_inventory.php?from=google&keyword=book_inv . . . > [retrieved Dec. 31, 2003]. pp. 1-2.

"Book Collector Features," Collectorz.com Book Collector, n.d., <http://www.collectorz.com/book/features.php> [retrieved Dec. 31, 2003]. pp. 1-2.

"Edge, Junction, and Corner Detection Using Color Distributions," ACM Portal, ACM, Inc. © 2004, <http://portal.acm.org/citation.cfm?id=505477&dl=ACM&coll=portal> [retrieved Feb. 24, 2004]. pp. 1-7.

"Technology and Services," Advanced Records Management Services, Inc., n.d., <http://www.armsrecords.com/pg4.html> [retrieved Dec. 31, 2003]. pp. 1-3.

"Visual Inventory Control Software," Dynamic Control Software, n.d. <http://www.dynamiccontrolsoftware.com> [retrieved Dec. 31, 2003]. pp. 1-3.

Feder, A., "A Look at Delicious Library 3.0 (images)," Think Secret, Aug. 3, 2004, <http://thinksecret.com/news/deliciouslibrary.html> [retrieved Jan. 19, 2005]. pp. 1-4.

"A Look at Delicious Library 3.0 Overview," Think Secret, Aug. 3, 2004, <http://thinksecret.com/archives/images/deliciouslibrary/Overview.html> [retrieved Jan. 19, 2005]. p. 1.

"Visual Inventory Control," Dynamic Control Software, <http://dynamiccontrolsoftware.com>, publicly available prior to Jun. 9, 2004, [retrieved Jan. 19, 2005]. pp. 1-2.

U.S. Appl. No. 10/864,291, filed Jun. 9, 2004, Lawrence Tesler et al.

U.S. Appl. No. 13/875,769, filed May 2, 2013, Lawrence Tesler et al.

U.S. Appl. No. 14/035,671, filed Sep. 24, 2013, Cheuk-Man Kong.

U.S. Appl. No. 14/036,657, filed Sep. 25, 2013, Cheuk-Man Kong.

U.S. Appl. No. 11/077,430, filed Mar. 10, 2005, Jonathan J. Shakes.

U.S. Appl. No. 11/077,485, filed Mar. 10, 2005, Jonathan J. Shakes.

ErgoSense, "Error Proofing Solutions" Electronic Designs, Inc., 2003, pp. 1-2.

Sun Microsystems, Inc., Sun Microsystems Researchers Unveil World's Smallest Secure Web Server, Win Best Paper Award at PerCom 2005, Dec. 23, 2004, pp. 1-2.

Jeff Hodgdon, "State-of-the-Art Direct Distribution at Nintendo of America," University of Wisconsin-School of Business, May 2001, pp. 1-8.

"AutoPICK is an Advanced Pick", printed from http://www.autopick.com/intro.html on Oct. 28, 2004, 1 page.

Crossbow Technology, Inc., Motes, Smart Dust Sensors, Wireless Sensor Networks, 2003, pp. 1-2.

Crossbow, "To Host PC, LAN or Internet," 2004, pp. 1-3.

Farhad Manjoo, "Dust Keeping the Lights Off," Lycos, Inc.—2004, May 28, 2001, pp. 1-3.

Marhsall Brain, "How Motes Work," HowStuffWorks, Inc., 1998-2005, pp. 1-8.

Dataweek, "Leading Lingerie E-Trailer Uses RFID Technology in Efficient E-Fulfilment Solution," Feb. 27, 2002, Technews Publishing (Pty) Ltd., pp. 1-3.

Stephanie Roussel-Dupre, "RFID Tag . . . You're It," Integrated Solutions for Ret@ilers, Jul. 2002, Integrated Solutions Magazine, pp. 1-2.

Paul Demery, "))) Beep, Beep, Listening to RFID," Apr. 2003, pp. 1-5.

RFID Journal, "RFID Helps to Perfect Order Picking," Apr. 2, 2003, RFID Journal, Inc., pp. 1-2.

LookSmart, "Crossbow Technology Releases Industry's First End-to-End, Low-Power, Wireless Sensor Network Solution for Security, Monitoring, and Tracking Applications," Mar. 2, 2005, pp. 1-2.

ThomasNet, "Workstation Provides Alternative Conveyor Systems," Jan. 30, 2002, Thomas Publishing Company 2007, pp. 1-2.

Adaptive Software, "Thirteen Simple Steps in Selecting a Picking Cart," ads Specialists, Inc., 2002-2003, pp. 1-2.

"Innovative Pick to Light Systems," Three Innovative Pick-to-Light Applications, Avery and Associates, Feb. 20, 2005, pp. 1-3.

"Innovative Picking Technologies, Inc., RF Batch Pick Cart," Material Handling Industry of America, printed from web on Apr. 20, 2007, pp. 1-2.

International Search Report and Written Opinion from PCT/US2006/008008, mailed Jun. 13, 2006, pp. 1-11.

* cited by examiner

INVENTORY LOCATION ILLUMINATION FOR DESIGNATING OPERATION PATH

BACKGROUND

Retailers, wholesalers, and other product distributors (which may collectively be referred to as distributors) typically maintain an inventory of various items that may be ordered by clients or customers. Distributors may store, (e.g., in a materials handling facility) multiple, different product items together in a single inventory location of an inventory area, such as a shelf, rack, bin, or drawer. For example, a facility may store items such as books, CDs, DVDs, electronic devices, clothing, toys, hardware, materials, and/or other items together in various combinations within each inventory location.

Various operations may be performed in a distribution facility. For example, operations such as receiving, stowing, picking, sorting packing and shipping may be performed at the facility. At some facilities various systems and processes may be relied upon in performance of the operations.

Some materials handling facilities may use paper-based lists or handheld devices as part of systems that direct agents to areas where operations within the materials handling facility are to be performed. The systems may rely upon alpha-numeric identifications for the locations and the agents may need to visually scan an area of locations (e.g., inventory locations) to locate the place where the operation is to be performed. The cognitive load placed on the agent while locating the place to perform the operation may depend upon characteristics of the type of operation to be performed (e.g., finding a narrow DVD case among many DVDs may take longer than randomly stowing a basketball among different types of items). Additionally, the physical layout of the materials handling facility may contribute to additional cognitive load being placed on an agent. For example, in a warehouse or distribution center with aisles between shelves of inventory, the agent may have to determine whether the location is on the left or the right side of the aisle or comprehend how the shelves are identified to find the location where the operation is to be performed.

Figure 1:
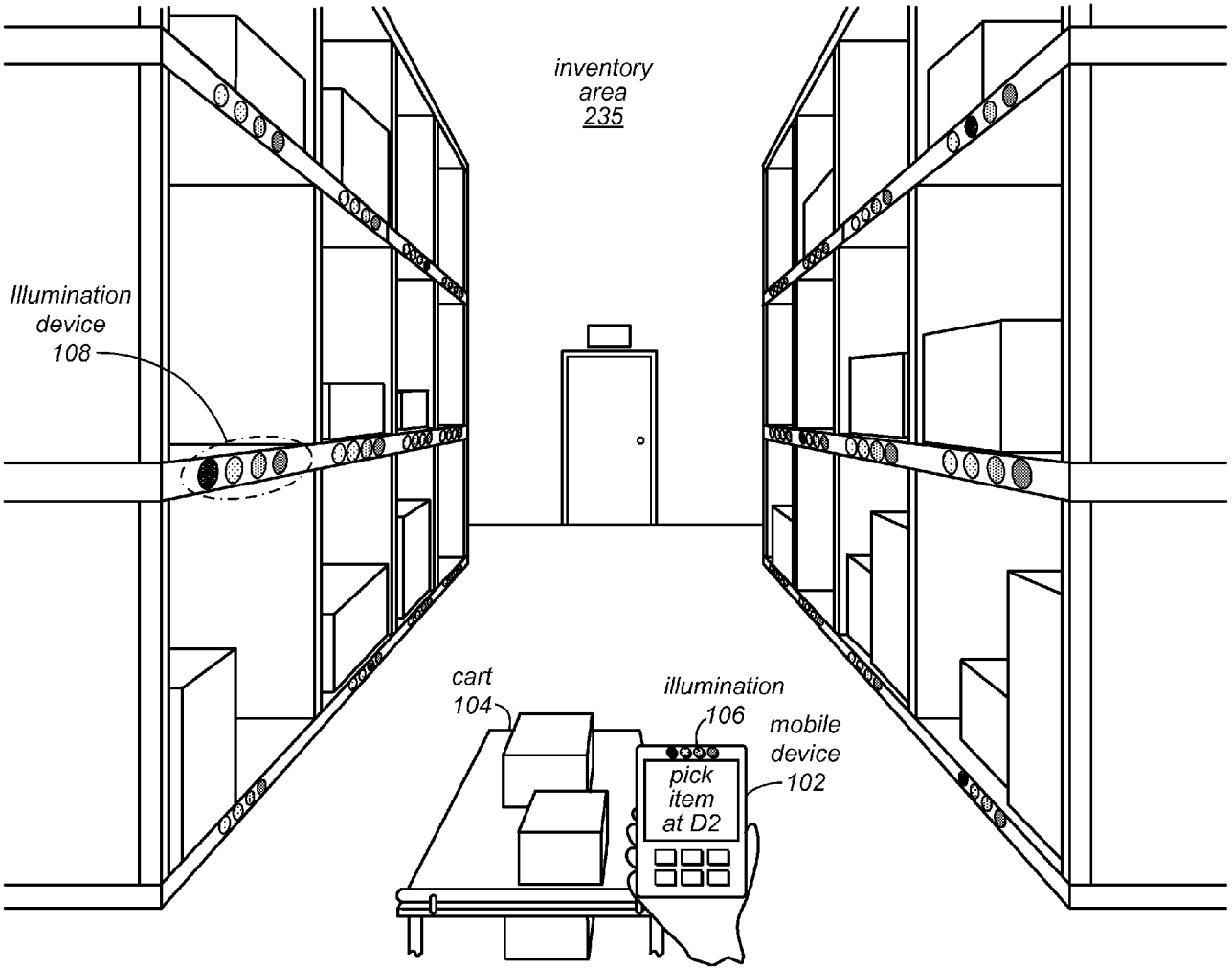
FIG. 1 illustrates an inventory area as viewed by an agent that is tasked with performing operations in the inventory area of a facility, according to some embodiments.

While embodiments are described herein by way of example for several embodiments and illustrative drawings, those skilled in the art will recognize that the embodiments are not limited to the embodiments or drawings described. It should be understood, that the drawings and detailed description thereto are not intended to limit embodiments to the particular form disclosed, but on the contrary, the intention is to cover all modifications, equivalents and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION OF EMBODIMENTS

In a materials handling facility, multiple, different product items may be stored together in a single inventory area, such as a shelf, rack, bin, or drawer. For example, a facility may store items such as books, CDs, DVDs, electronic devices, clothing, toys, hardware, materials, and/or other items together in various combinations within each inventory area. Items may be stored in inventory areas by an agent, either randomly, pseudo-randomly or according to one or more guidelines, with an inventory area selected for each item automatically, such as by software executing on a control system, in some embodiments. An agent may be tasked with finding locations in an inventory area to perform an operation, for example, picking or stowing an item at the location. Agents may rely upon devices to direct the agent to the location where the operation is to be performed.

An illumination-based control system and illumination devices that correspond to locations within the facility may be used to facilitate operations in such a materials handling facility, including, but not limited to stowing and picking operations. For example, a control system may be configured to determine a set of inventory locations where an operation (e.g., a pick or stow operation) may be performed by an agent. The control system may assign a particular pattern to an agent tasked with performing the operation at the set of inventory locations and send instructions to a corresponding set of illumination devices that may be instructed to illuminate the respective inventory locations. Such a system may facilitate operations in the materials handling facility by making the agent visually aware of the inventory areas where the operation is to be performed. For example, the agent may see the inventory locations that are illuminated by the illumination devices and determine a path to take between the illuminated devices such that the distance traveled between the illuminated inventory locations where the agent performs the operation is minimized.

An illumination-based control system may comprise various components in various arrangements. In one example, the illumination-based location identification system may comprise a control system and any number of variously configured devices used to illuminate locations or display information about locations. In another example, an illumination-based location identification system may include fewer or more components such as a scanner and/or display device. Various other arrangements and combinations of the various components described herein are also contemplated. In some embodiments, the processes disclosed herein at the direction of the illumination-based control system may be practiced in addition to prior known operations (e.g., paper-based pick list operations) but may be practiced in place of prior know processes as well.

A control system may determine a set of inventory locations where an inventory operation is to be performed. The inventory locations may include devices capable of illuminating with illumination patterns. For example, an illumination pattern may be illuminated at an inventory location to indicate the location where an operation is to be performed. In some embodiments, a particular illumination pattern may be assigned to an agent such that the agent is tasked to perform an operation at locations with the illuminated pattern. The control system may send instructions to the illumination devices that correspond to the set of inventory location that were determined for the operation. The instructions may designate the inventory locations with the particular illumination pattern assigned to the agent.

In some embodiments, the agent or agents may use mobile devices to perform the operations. For example, the agents may read an instruction of an operation to perform and/or the location where the operation should be performed from a display of the mobile device. The control system may send instructions to an agent's mobile device instructing the agent to perform the operation at an inventory location. The instructions sent to the mobile device may be coordinated with instruction directing illumination of a device at the location as well, in some embodiments.

The mobile devices may be capable of scanning inventory items, inventory locations and the like such that information about the item and/or the location is determined by the device. The mobile device may send the information to the control system. For example, the agent may use the mobile device to scan an inventory location where an operation (e.g., a pick operation) is to be performed (e.g., for an item). The mobile device may gather the information from the scan of the inventory location and send the information to the control system such that the control system confirms that the inventory location that was scanned was the correct inventory location to perform the operation. In some embodiments, the control system may use the confirmation of the inventory location to determine that the operation was performed.

The control system may instruct illumination of the illuminated pattern at inventory locations to cease. For example, the control system may instruct de-illumination of the illumination pattern in response to receiving information from the mobile device indicating that the operation has been performed at the inventory location, such as the scan information. In some embodiments, the control system or the mobile device may determine whether there is another location to perform the operation in the same inventory area. For example, the mobile device may have a list of inventory locations where an agent is tasked with performing an operation, the mobile device may recognize from the scan information that the operation has been performed at one of the designated inventory areas and may display the next inventory area on the list to the agent. The agent may move to the location, perform the operation and scan the inventory location. This process may be repeated over again until all of the inventory locations have been scanned by the mobile device, for example.

In some embodiments, the mobile device or the control system may determine whether there are additional inventory locations where the operation is to be performed in other areas. For example, a first few of the set of inventory locations may be in an inventory area where inventory is stored in storage bins while the last few items of the set of inventory location may be in an inventory area where inventory is stored on shelves. In some embodiments, the storage shelves may be divided into separate inventory areas, such as aisles for example.

In embodiments, illumination devices may be used to indicate groups of inventory locations, areas of inventory or groups of areas of inventory. For example, illumination devices at the head of each aisle may be used to indicate to the agent that some of the other aisles hold inventory that are on the agents pick list. Such illumination may be helpful when the agent is at the head of an aisle and other aisles are in view, for example. Agents may use the information presented by the illumination devices at the head of each aisle to plan a route for picking, in some embodiments.

The methods described herein may in various embodiments be implemented by any combination of hardware and software. For example, in one embodiment, the methods may be implemented by a computer system that includes a processor executing program instructions stored on a computer-readable storage medium coupled to the processor. The program instructions may be configured to implement the functionality described herein (e.g., the functionality of the control system, product database, mobile devices, and/or other devices such as scanners, for example).

Various processes associated with illuminating inventory locations are disclosed. FIG. 1 illustrates an inventory area of a material handling facility according to some embodiments. FIG. 1 illustrates an aisle in between two shelving units each comprising twelve inventory locations, Illumination devices such as those shown at 108 are associated with respective inventory locations of the inventory area 235. As illustrated in FIG. 1, each inventory location in the inventory area may be associated with or may be indicated by an illumination device such as illumination device 108.

Each of the depicted illumination devices, such as illumination device 108 of FIG. 1 are depicted with four round lens members, each lens member of a different pattern. However, it is contemplated that illumination devices may be any of various configurations without departing from the scope of the invention. The illumination devices may be composed of lasers or other projected illuminants such as focused light beams or composed of reflective devices, or composed of LEDs such as a LED matrix display of a single or multiple colors or shapes, for example. In some embodiments, the illumination devices may be composed of selectable buttons of various shapes and colors that may send a signal to the control system when selected, indicating that the operation has been performed at the location. In some examples, illumination devices may be configured with reset buttons that de-illuminate or cease the illumination and/or send a message to the control system indicating that the illumination device has been reset. In embodiments, the illumination devices may be configured with various illumination patterns such as colors, shapes, blink rates or combinations thereof for example, although other visual characteristics may be incorporated as well without departing from the scope of the invention.

In some embodiments, an illumination pattern may include blinking or flashing of the illumination device. For example, in FIG. 1, illumination device 108 is illustrated with a single illuminated member (the solid black circle on the left). However, it is contemplated that the illumination device may be configured to blink or flash as part of the illumination pattern. For example, the illumination device may have a limited number of colors or shapes to illuminate and may be configured to blink the same color or shape to indicate a distinct illumination pattern from a steady illumination. The illumination device may be configured to blink or flash at varying rates to indicate various illumination patterns that may be associated with different agents.

In some embodiments, multiple illumination devices of an inventory area such as inventory area 235 may be coordinated to blink or flash in a coordinated fashion. For example, illumination device 108 may flash initially to indicate that performing the operation at the inventory location corresponding to illumination device 108 should be performed before the operation is performed at a subsequent inventory location corresponding to another illumination device that flashes subsequent. Additional flashing illumination devices may be coordinated.

In the illustration the lens members of illumination device 108 are depicted with distinct shades or patterns of grey that match the same shades or patterns of grey of the illumination 106 lens members depicted across the top of mobile device 102. However, it is contemplated that various colors, shapes, pictures or other graphic depictions and combinations thereof may be incorporated to create distinct illumination patterns. In some embodiments, the same illumination pattern may be used to indicate the operation for two or more agents. For example, if two or more agents are operating in the same inventory area, it may still be beneficial to illuminate all of the inventory locations where all of the agents are to perform operations, even with the same illumination pattern. In such an arrangement, the illumination of the inventory locations with the same illumination pattern may reduce the cognitive load on the agents because the agents can ignore inventory locations that are not illuminated and focus on distinguishing the inventory locations assigned to the respective agent from the smaller set of illuminated inventory locations.

In the embodiment depicted, an agent is approaching the inventory area 235 with cart 104 that may be used to carry inventory items to or from the inventory locations of inventory areas. As the agent approaches the inventory area, the agent may observe that the mobile device 102 the agent is carrying displays an indication of a particular inventory location. In the illustrated example, the display instructs the agent to pick the item at D2 of the inventory area.

Illumination device 108 is illustrated with the illumination pattern furthest to the left illuminated for the inventory location. The agent may observe that the illuminated pattern is the one that the agent is assigned to. In some embodiments, the agent may observe that the illuminated pattern of illumination device 108 matches the illumination 106 on the mobile device 102.

Other illumination devices associated with other inventory locations are depicted as illuminated in FIG. 1. Some of the illuminated devices match the illumination pattern of illumination device 108 while some of the illuminated devices are illuminated with a different illumination pattern. In FIG. 1, illumination of any pattern is depicted with a darkened black circle due the nature of the black and white illustrations, but the patterns are in the same order for each device illustrated. However, it is contemplated that the illumination devices may illuminate as various colors, shapes, blink rates and the like. In some embodiments, each one of the four circles of an illumination device may be a different color or shape or blink rate while in other embodiments, each one of the four circles may be the same pattern.

As illustrated in FIG. 1, as an agent approaches an inventory area, an agent may observe a view of many of the inventory locations at once. The illumination of designated inventory locations within that view allows an agent to comprehend the locations where the operation should be performed with less cognitive effort. Observing the illuminations from this point of view may allow the agent to select an efficient path to traverse between the designated inventory locations of the inventory area.

Figure 2:
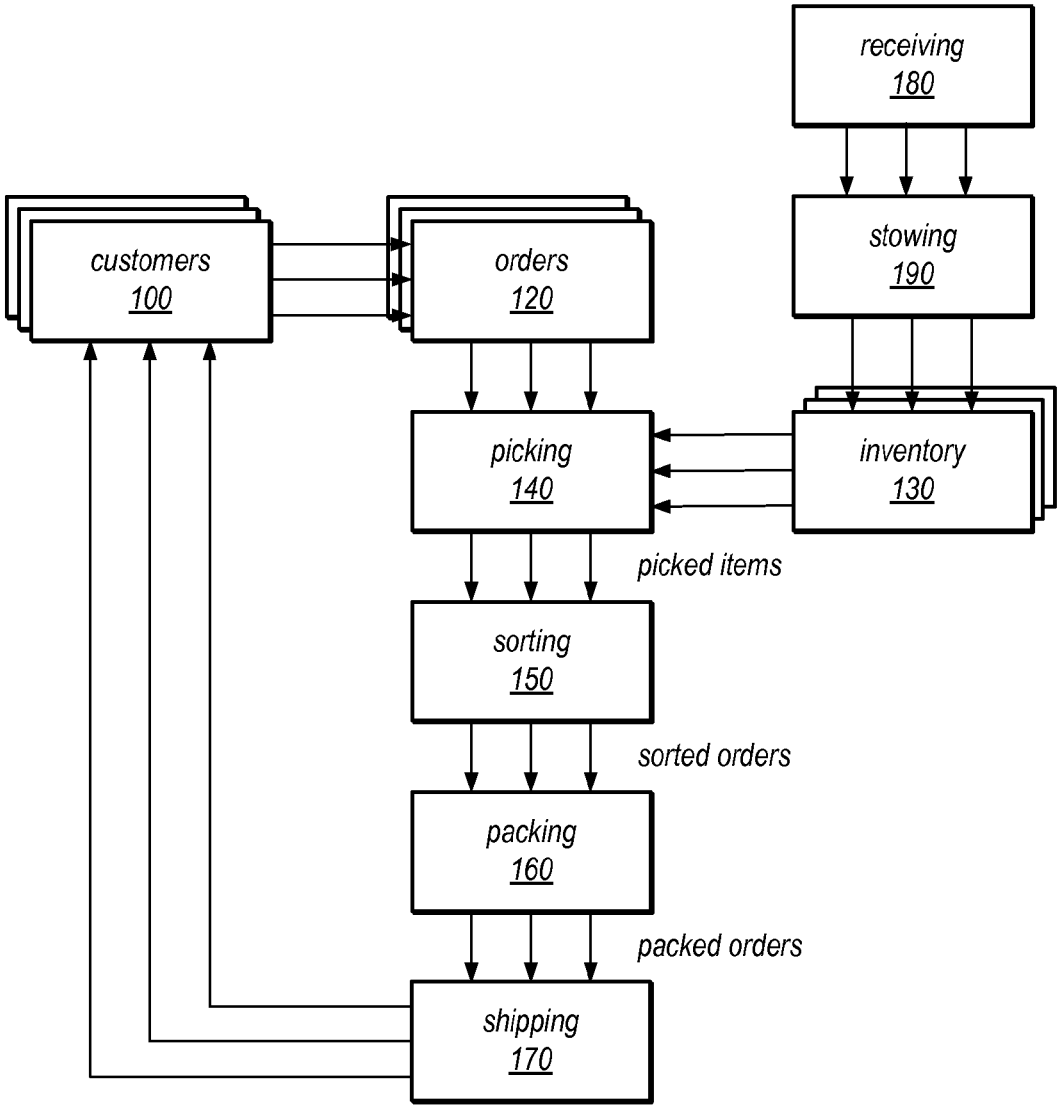
FIG. 2 illustrates a logical representation of various operations of a materials handling facility, according to some embodiments.

An order fulfillment facility or other materials handling facility may include an inventory management system employing an illumination-based control system in various operations of the facility. FIG. 2 illustrates a broad, view of the operations of one such facility, which, in one embodiment, may be configured to utilize an illumination-based control system as described herein. In this example, multiple customers 100 may submit orders 120 to the distributor of the items in the facility, where each order 120 specifies one or more items from inventory 130 to be shipped to the customer that submitted the order. To fulfill the customer orders 120, the one or more items specified in each order may be retrieved or "picked" from inventory 130 (which may also be referred to as stock storage) in the order fulfillment facility, as indicated by block 140. In some embodiments, agents may identify inventory locations in inventory 130 for performing operations based on a corresponding illumination pattern at the inventory location, as described herein. In various embodiments, the illumination pattern presented may include a color, a pattern, a blink rate or the like such that the agent that is associated with the illumination pattern can readily identify inventory locations that are illuminated with the illumination pattern. Picked items may be delivered to one or more stations in the order fulfillment facility for sorting 150 into their respective orders, packing 160, and finally shipping 170 to the customers 100. A picked, packed and shipped order does not necessarily include all of the items ordered by the customer; a shipped order may include only a subset of the ordered items available to ship at one time from one inventory-storing location.

An order fulfillment facility typically also includes a receiving operation 180 for receiving shipments of stock from various vendors and a stowing operation, illustrated as stowing 190, for placing the received stock into stock storage (inventory 130). In some embodiments, stowing 190 may involve stowing an item in a location within inventory 130 selected by a control system (e.g., randomly, pseudo-randomly, or according to various guidelines for stowing similar or different items within the facility). Various embodiments may implement the illumination-based control system to facilitate stowing an item by illuminating inventory areas that have been determined by the control system as areas for stowing. In some embodiments, stowing 190 may involve scanning the item and/or the inventory location when adding items to one of the plurality of inventory areas in inventory 130. An illumination-based control system may, in some embodiments, be used to direct a stowing agent to a particular location and/or position within the inventory area and/or location in which an item is to be stowed, as described herein.

In some embodiments, an order fulfillment center may receive an order for an item not currently in the center's inventory. When the item is received, the order may then be filled and shipped. When an order is received for an item before the item has been received at an order fulfillment center, the received item may or may not be stocked into inventory before being matched up with the order and shipped out, according to various embodiments. The receipt of the item at the facility may trigger the fulfillment process for a pending order. The various operations of an order fulfillment facility may be located in one building or facility, or alternatively may be spread or subdivided across two or more buildings or facilities.

Positional item information and/or item images, as described herein in various embodiments, may be used to locate a given item to be picked from inventory 130. For example, in some embodiments, fulfillment center personnel, sometimes called agents, who retrieve ordered items from inventory 130, may be presented with position and/or descriptive information to quickly locate specific items in inventory 130 without, for example, having to read an item label, such as a book or CD title. The position and/or item images may be presented to the agents using an item image display system, such as the mobile device depicted in FIG. 1. In another example, one or more item image display devices may be mounted within the facility and may display position information and/or item images so they are visible to the agents. Image display devices may include but are not exclusive to hand-held display devices, stationary display devices, screen-based display devices or image projection display devices, etc.

An illumination-based control system, as described herein, may be utilized in a number of different facilities and situations, including, but not limited to material handling facilities, order fulfillment centers, rental centers, distribution centers, packaging facilities, shipping facilities, libraries, museums, warehouse storage facilities, shopping centers, grocery stores, car parking lots, etc. In general, an illumination-based control system may be used in any situation in which an operation is to be performed at a location.

An illumination-based control system as described herein in various embodiments, may be utilized in several areas of a materials handling or order fulfillment facility such as during receiving 180, stowing 190, picking 140, sorting 150, packing 160, and shipping 170. For example, in some embodiments an illumination-based control system may illuminate inventory locations to agents who retrieve ordered items from inventory 130, so that they may quickly locate and identify specific items in inventory 130. Sorting agents, who sort items collected by picking agents, may utilize an illumination-based control system to speed the process of grouping items by order. For example, an illumination-based control system may present to the agent illuminated indications for items that are to be grouped together into containers that are illuminated or correspond to an illumination device that is illuminated so as to designate the source and destination of the sorted item.

An illumination-based control system may also aid packing agents to efficiently select an appropriately sized container for shipment, to locate the correct hopper or container being used to ship a group of items, to direct a group of items to the correct packing station, or to perform other operations, according to various embodiments. In yet another embodiment, illumination and illumination devices may be used in a receiving station of a materials handling facility. For example, receiving personnel may be presented with illuminations to direct them to place received items on a particular pallet or conveyor belt, or to deliver the items to a particular inventory area within the facility for unpacking and storage. In some embodiments, empty available locations may be designated by illuminating the corresponding illumination device in accordance with the processes described herein.

The arrangement and order of operations illustrated by FIG. 2 is merely one example of many possible embodiments of the operation of an order fulfillment facility utilizing an illumination-based control system. Other types of materials handling, manufacturing, or order fulfillment facilities may include different, fewer, or additional operations and resources, according to different embodiments.

Figure 3:
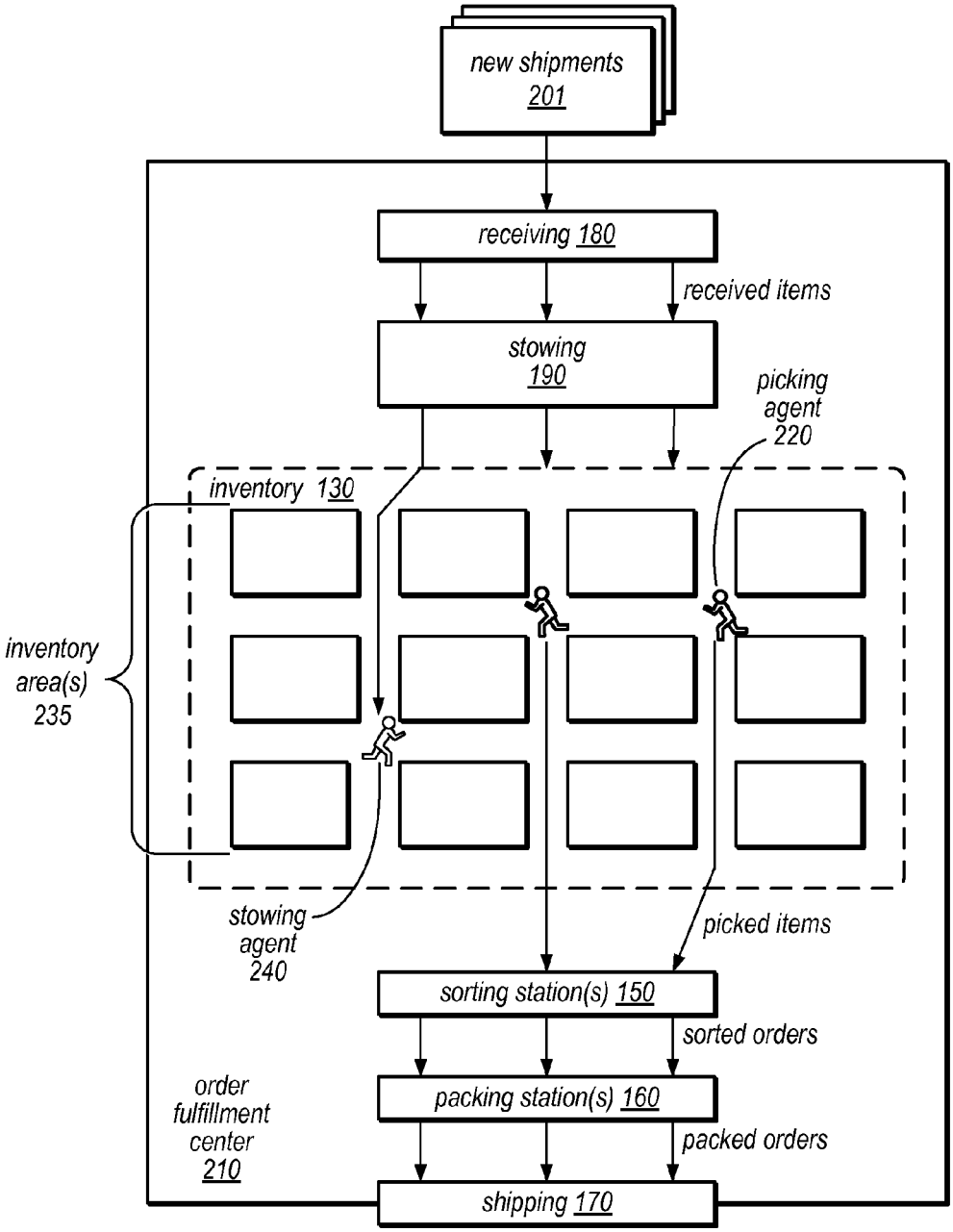
FIG. 3 illustrates a high-level physical layout of a materials handling facility, according to one embodiment

The stations of an order fulfillment center may be arranged in many different configurations, according to various embodiments. FIG. 3 illustrates an arrangement for an order fulfillment center 210, according to one embodiment. At any time, one or more picking agents 220 may each be picking items from inventory 130 to fulfill portions or all of one or more orders, and/or one or more stowing agents 240 may be placing items in inventory 130. According to some embodiments, an illumination-based control system may direct illumination devices to present illumination patterns to picking agents 220 and stowing agents 240, for example, to increase speed and efficiency when searching for particular inventory locations in an inventory area. For example, an illumination-based control system may direct illumination of an illumination device corresponding to an inventory location for a picking agent 220, provide picking agent 220 with instructions to direct him or her to a particular inventory area 235, and additional information (e.g., position information, dimension information, image(s) of the item, image(s) of the item in the inventory area or other descriptive information) to assist him or her in locating one or more items in an inventory location of the inventory area 235.

After obtaining items from inventory 130, picking agents 220 may transfer those items to sorting stations 150, according to one embodiment. Not every fulfillment facility includes both sorting and packing stations. In certain embodiments, agents may transfer picked items directly to a packing station, such as packing station 160, and the picked items may be directed to a particular packing station by a control system (e.g., control system 414 in FIG. 4). In other embodiments, agents may transfer picked items to a combination sorting and packing station (not illustrated). This may result in a stream and/or batches of picked items for multiple incomplete or complete orders being delivered to a sorting station 150 for sorting into their respective orders for packing 160 and shipping 170, according to one embodiment illustrated by FIG. 3. Portions of an order may be received at different times, so sorting 150 and packing 160 may have to wait for one or more items for some orders to be delivered to the sorting station(s) 150 before completion of processing of the orders. A stream or batches of incoming picked items may be sorted into their respective orders at the sorting station(s) 150. While, in some embodiments, automated sorting may be utilized, such as through the use of Crisplant® or Eurosort® sorters, in other embodiments sorting may be performed manually. In yet other embodiments, both manual and automatic sorting may be used in combination. Once an order is completed at a sorting station 150, the order may be ready to proceed to a packing station 160 to be packaged for shipping 170.

Figure 4:
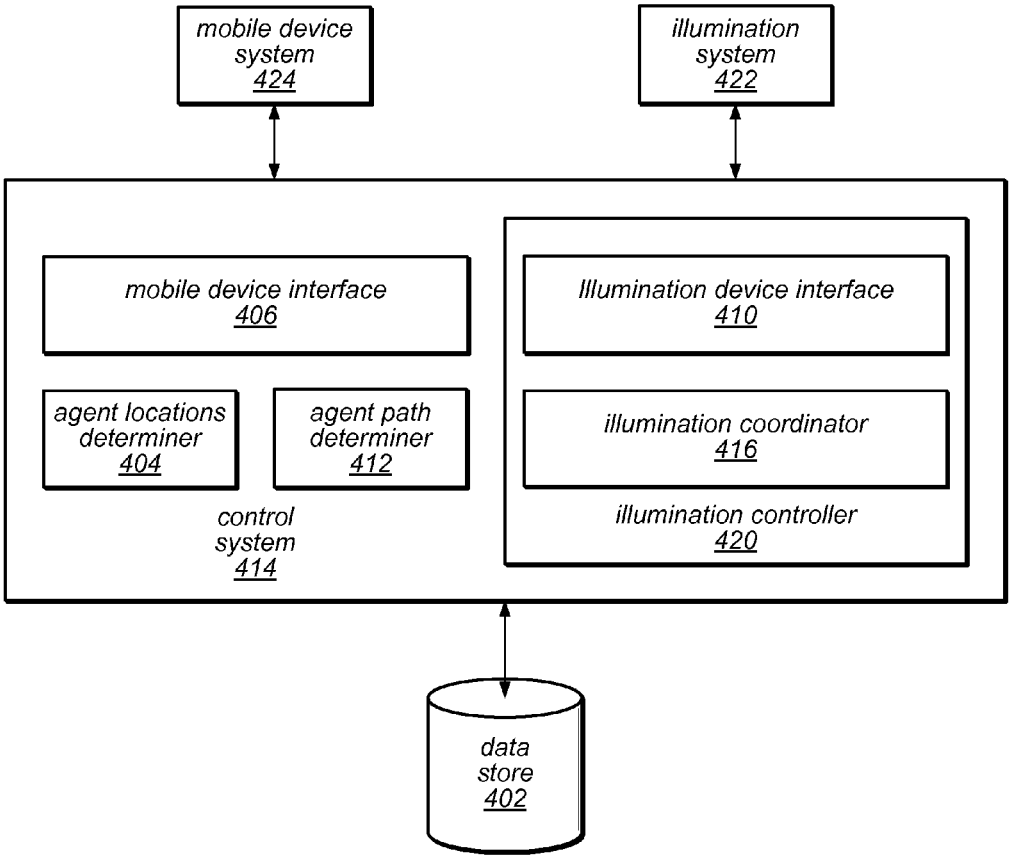
FIG. 4 illustrates a control system, in accordance with some embodiments.

An order fulfillment facility such as an order fulfillment center 210 may implement an illumination-based control system, or control system for short, as part of its overall inventory management system. A control system (such as illustrated in FIG. 4 and described below) may include hardware and software configured for assisting and/or directing agents in the order fulfillment center 210 in fulfilling customers' orders. For example, in some embodiments, such a control system may instruct illumination of illumination devices corresponding to inventory locations and transmit information such as instructions, operations, inventory locations and item information to display devices, which may display the instructions and other information such as instructions, operations, inventory locations and item information to a picking agent 220 or a stowing agent 240.

Items in inventory 130 may be marked or tagged with a bar-code, radio frequency identification (RFID) tag, Universal Product Code (UPC), Stock-Keeping Unit (SKU) code, serial number, and/or other designation (including proprietary designations) to facilitate order fulfillment center 210 operations, including, but not limited to, picking 140, sorting 150 and packing 160. These designations, or codes, may identify items by type, and/or may identify individual items within a type of item. The control system may also include, or may be used in conjunction with, handheld, mobile and/or fixed scanners or scanning devices that may be able to scan the marks or tags on individual items and/or inventory areas 235 to determine and record an identifier of an item and/or an item location. In some embodiments, a control system may be configured to access location, position and/or descriptive information for items (e.g., from a product database or other data store) and may provide this information to picking agents 220 along with other information indicating items to be obtained from inventory, as will be described in more detail below. Inventory locations may also be marked in a similar fashion.

The control system may, in some embodiments, be configured to determine the location and/or position of a picking agent 220 or a stowing agent 240 (e.g., using an indirect asset tracking device or other communication device worn or carried by the agent) and may generate instructions to perform operations (e.g., stowing or picking instructions for the agent) that are dependent on the agent's current location within inventory 130. For example, the control system may transmit messages including instructions for the agent to a mobile device (e.g., mobile device 102 in FIG. 1) that is near the agent, and this mobile device may display information suitable for directing the agent from his or her current location to the location of an item to be picked or stowed.

As described above, an order fulfillment center may include one or more receiving stations 180 for receiving shipments of stock from various vendors. The received stock may then be placed into stock storage in one or more inventory areas 235 of inventory 130 during a stowing operation (illustrated as stowing 190 in FIG. 2), in some embodiments. As described above, the control system may, in some embodiments, be configured to determine the location and/or position of a stowing agent 240 and may generate stowing instructions for the agent that are dependent on the agent's current location within inventory 130. For example, the control system may transmit messages including instructions for the agent to mobile device 102 that is near the agent, and this mobile device 102 may display visual guidance suitable for directing the agent from his or her current location to the location in inventory in which an item is to be stowed. The control system may send instructions designating an illumination device corresponding to the location to illuminate with an illumination pattern. The agent may navigate to the illuminated illumination device at the designated inventory location and scan the inventory location such that the control system receives the information from the scan as confirmation of performance of the operation and sends an instruction to the illumination device corresponding to the inventory area to cease illumination of that illumination pattern associated with the agent.

During stowing 190, the control system may determine the locations and/or positions for stowing items in inventory areas 235 randomly, pseudo-randomly, or according to one or more positional placement guidelines, in different embodiments. When an item is stowed, an indicator of its position may be stored in a product database and associated with a product identification code or other item or product information, in some embodiments. According to certain embodiments, the position information may then be available to control system devices, communication devices, or other computer devices, as described below. For example, a control system may access the position information and may use it to instruct an illumination device to illuminate with an illumination pattern that has been assigned to the agent. The control system may use the position information to generate messages that include instructions for a picking agent that are transmitted to a mobile device and presented to the picking agent when the item is included in a customer order. Similarly, dimension information may be captured or estimated, and/or pattern-based information may be assigned or captured, for items received and stored in inventory 130 and this information may be stored in a product database and associated with a product identification code or other item or product information. This descriptive information may be accessed by the control system, transmitted to a device, and presented to a picking agent instead of, or in addition to, any position information associated with the item, in different embodiments.

As described above, many fulfillment facilities store different copies of items in different individual inventory areas within stock storage. Storing copies of items in multiple inventory areas may shorten the distance, and therefore the time, required to obtain an item from inventory, in some embodiments. Additionally, different items may be stored in a single inventory area, according to certain embodiments. Storing different items together may result in more efficient use of total inventory space than using a single inventory area for multiple copies of a single item or product. It still may be beneficial in some embodiments to store similar items together to make better use of inventory space. For example, storing different books together on a single inventory shelf may use the available inventory space more efficiently than storing one book among other items of greatly differing size and shape, such as electronic devices, clothing, toys, hardware, materials, or other items. Thus, in some embodiments, a fulfillment facility may store items of similar shape and size together in a single inventory area. For instance, in such an embodiment, items such as books, compact discs (CDs), and digital video discs (DVDs) may all be stored together. In some embodiments, multiple copies of an item may be stored together with multiple copies of other, different items. For example, a single inventory area may store multiple copies for each of several different books, CDs, or other items.

In certain embodiments, items may be randomly stored together in inventory areas. Such random storage may increase storage efficiency and may in some cases increase the likelihood that any individual item may be easily distinguished from the other items with which it is stored. Random storage of items may also decrease the amount of time needed to store individual items into inventory. A control system for the facility may track where each item is stowed. As previously described, in some embodiments, determining where to store an item may be performed manually, while in other embodiments, it may be an automated process performed by one or more computer software programs based on pattern information associated with the individual items, and/or based upon positional placement guidelines, as described below.

When obtaining a particular item from an inventory area storing different items, picking agents may have to carefully examine each item in the inventory area to properly identify the specific item to be picked. For example, if a picking agent is instructed to obtain a single copy of a book, CD, or DVD that is stored among other different books, CDs, or DVDs, the agent may have to read the title of each item in turn to identify the specific one to pick. For example, it may take a picking agent additional time to distinguish from among multiple, different CDs all of whose titles include "Greatest Hits."

In some embodiments, an illumination device may be used to indicate position information corresponding to the relative position of the item to be picked, so that the agent may not have to carefully read the title of each CD in the inventory area until the correct one is encountered.

As described above, a fulfillment center configured to fulfill orders may include a plurality of receiving stations in receiving 180 configured to receive items for storage, a plurality of inventory locations in inventory 130 configured to store the received items, and a plurality of packing stations 160 configured to package items selected from the inventory locations. An agent may traverse the fulfillment center 210, directed to the appropriate inventory areas and/or inventory locations by an illumination device (e.g., illumination device 108 in FIG. 1) corresponding to the inventory area and/or location, and may select each item from one or more of the inventory locations. The agent may use additional information presented by a device to locate each item within an inventory location and transfer it to one of the packing stations. In some embodiments, a handheld communication device may be used to scan an identifier of a picked item to determine if it is the correct item. Similarly, during a stowing operation, an agent may be directed to a particular inventory area by a corresponding illumination device, and then the agent may use a handheld communication device to scan an identifier of the inventory area and/or to enter information indicating the position within the inventory area at which the item was actually stowed. For example, a handheld communication device (e.g., mobile device 102 in FIG. 1) may include a scan device for reading bar-type scan codes, such as a SKU or ISBN on an item or may be configured to communicate with a separate scan device to receive such codes and communicate them to the control system.

In embodiments in which various steps of a stowing operation are automated, agents may still use an illumination-based control system in a manual or semi-automated picking operation. For example, in one embodiment, pick lists may be automatically generated by control system 414. The control system 414 may be configured to automatically determine the location of one or more agents within the facility, a targeted inventory area for a picking operation, an illumination device corresponding to the inventory location to instruct to illuminate, a path from the current location of the picking agent to the targeted inventory area, and position and/or descriptive information associated with the location of an item. Control system 414 may then generate and send messages to the illumination device to illuminate and to a mobile device to direct an agent in the picking operation, as described herein. Control system 414 may also be configured to automatically track the location of the picking agent and the progress of the picking operation, using scanners, cameras, or other communication devices configured to automatically detect identifiers of agents, items, and/or other components in the facility.

FIG. 4 illustrates a control system 414 (e.g. an illumination-based control system), an illumination system 422, a mobile device system 424 and data store 402. FIG. 4 illustrates that illumination controller 420 may be part of and interact with the control system 414 and may be coupled to data store 402. Alternatively, part or all of illumination controller 420 may be separate from control system 414 and perform functions separate from control system 414. In some embodiments, data store 402 may be an enterprise data store configured to store all or most of the data of an enterprise (e.g., materials handling facility). In other embodiments, data store 402 represents a distributed collection of various independent data stores each tailored and particularly suited to the data contained therein. As illustrated in FIG. 4, data store 402 stores location information for each item, and correspondence information for the illumination devices that correspond to inventory locations of each item. The location information for each item may indicate a location at which the item was stowed or a location at which the item is to be stowed (e.g., the location at which the control system determines it should be stored, whether or not the stowing operation has been completed). The correspondence information may indicate the illumination device that corresponds to the inventory location. Data store 402 may also include another data store, such as a product database for storing location information associated with each item handled within the facility.

In embodiments, the control system 414 may be configured to send and receive inventory locations from and to data store 302 as well as various devices of the materials handling facility (e.g., mobile device 102 of FIG. 1)). The control system 414 may be configured to access the stored location information for a given item when determining the designated inventory location and when determining the set of inventory locations. The control system 414 may include various software modules that each provides various specialized functionality pertaining to locations of inventory, agents and illumination devices. While the software modules are illustrated as part of control system 414, alternative embodiments are contemplated wherein any of the software modules exist outside of the control system 414.

As illustrated in FIG. 4, control system 414 may interact with mobile device system 424. In some embodiments, mobile device system 424 includes the hardware and software of the mobile devices used by agents in performance of the operations in the materials handling facility. For example, control system 414 may send instructions to mobile device system 424 instructing a mobile device to display an indication of an inventory location and/or an instruction to be performed at the location. The agent may scan an inventory location and/or inventory item while performing the operation and the mobile device system 424 may send the information from the scan to control system 414 to confirm the operation was performed.

Also illustrated in FIG. 4, control system 414 may interact with illumination system 422. Illumination system 422 includes illumination devices that may illuminate an illumination pattern, in some embodiments. In various embodiments, each illumination device corresponds to a location where an operation is to be performed. For example, in a materials handling facility (e.g., order fulfillment center 210 of FIG. 3) numerous illumination devices of illumination system 422 may correspond to numerous respective inventory locations. The numerous illumination devices may correspond to numerous respective receiving areas, numerous respective sorting stations, numerous respective packing stations and the like, for example. Illumination devices of illumination system 422 may be used to indicate any location where an operation is to be performed and control system 414 may control the illumination and de-illumination of the illumination devices.

Control system 414 may include illumination controller 420, as illustrated in FIG. 4. Illumination controller 420 may control illumination of illumination patterns for the illumination devices of the illumination system 422 via illumination device interface 410. In some embodiments, the illumination devices may send and receive instructions, messages or signals to and from illumination device interface 410. In the illustrated embodiment, illumination controller 420 includes illumination coordinator 416 for coordinating illumination of the illumination devices for the associated agents. For example, illumination coordinator 416 may assign particular illumination patterns of numerous available patterns to particular respective agents.

FIG. 4 illustrates that control system 414 may include a mobile device interface 406, agent locations determiner 404 and agent path determiner 412. Mobile device interface 406 may support sending and receiving messages between the mobile device system 424 and control system 414. Agent locations determiner 404 may determine the locations of the agents. For example, agent locations determiner 404 may receive location information from a mobile device being used by the agent or by various other technologies describes herein such as selectable members of the illumination devices corresponding to the inventory locations. In some embodiments, the location of the device may be determined by various types of signal triangulation or from the scan information sent from the device.

In some embodiments, the location of the agent may be determined by GPS, but it could be determined using other technologies, such as Wi-Fi triangulation, NFC (near field communication), Bluetooth or other forms of triangulation that can determine the agent's position. In some embodiments, other tools such as site-specific knowledge, landmarks etc. may be relied upon to identify where the agent is located. For example, as an agent operates in an area, the agent may use an electronic device to scan an item of inventory or an inventory location as part of the operation. In some embodiments, both the inventory location and an item of inventory may be scanned while in other embodiments, the inventory location may be assumed from a match of the scanned item information to a list of items to be picked such that the scan of the inventory location may be unnecessary. In some embodiments, the information from the scan may be sent to the control system 414, for example via mobile device interface 406. The scan information may be used to confirm the operation was performed or to locate the position of the agent.

In some embodiments, the illumination coordinator 416 may change the illumination pattern assignment of an agent. For example, an agent's assigned illumination pattern may be changed when the agent nears a new aisle where the agent's assigned illumination pattern is already being used to direct another agent.

Agent path determiner 412 may determine a set of locations in an area where an operation is to be performed. The set of locations may be selected so as to define a path for an agent to take to perform an operation at the locations. For example, agent path determiner 412 may determine a set of inventory locations where items should be picked in an aisle of an inventory area (e.g., inventory area 235 of FIG. 1). Agent locations determiner 404 may determine the location of an agent from a mobile device over mobile device interface 406, as described above. Agent path determiner 412 may receive the determined location from agent locations determiner 404 and select a set of inventory locations near-to the present location of the agent for performing an operation. The illumination coordinator 416 may select a particular illumination pattern to assign to the agent and direct the illumination system 422 to designate all of the inventory locations in the set with the particular illumination pattern via illumination device interface 410, for example.

In some embodiments, illumination coordinator 416 may coordinate the illumination devices to blink or flash in a sequence. For example, subsequent to a set of inventory locations being determined, the agent locations determiner 404 may determine an agent to be assigned to the set or assigned to an illumination pattern assigned to the set. The determination may be based on the agent's location to the set of inventory locations or the agent's familiarity with the set of locations, for example. In some embodiments, the determination may be based on the availability of an agent to perform the operation. The control system 414 may send instructions to the agent via mobile device interface 406 to navigate to a first one of the set of inventory locations assigned to the agent. As the agent nears the set of inventory locations, the illumination controller 420 may send an instruction to the illumination system 422 to illuminate the illumination devices of the corresponding inventory locations with the illumination pattern assigned to the agent. In some embodiments, the agent may scan the first location and scan information may be sent to control system 414 where the agent locations determiner 404 determines that the agent is at the first location of the set of locations and notifies the illumination coordinator 416 of the agent's location. The illumination controller may receive the notification of the location of the agent at a (e.g. a first) location of the set and send an instruction to the rest of the inventory locations to change from a steady illumination to a blinking or flashing illumination. In some embodiments, the flashing may be coordinated in a sequence, for example, to indicate a suggested order. The sequence may indicate a preferred or suggested order of operation performance. In some embodiments, only the next suggested inventory location of the set of locations may be designated to blink while the set of corresponding illumination devices for the remaining inventory locations are directed to illuminate with steady illumination.

In some embodiments, the illumination coordinator 416 may communicate with other modules of the control system 414 (e.g., agent locations determiner and agent path determiner 412) to plan sequences of agent operations such that agent congestion is avoided in inventory areas. In some embodiments, the illumination coordinator may implement thresholds or ratios that control the number of agents operating in an area. The control system may default to a process of directing agents to perform operations without the illumination process described herein, for example, when no more illumination patterns are available to assign or when the illumination system malfunctions, for example.

The various modules of control system 414 may coordinately function to reuse illumination patterns (e.g., in separate non-overlapping areas of the facility) such that two or more agents may operate as indicated by the same illumination pattern. In some embodiments, the illumination controller may illuminate a subset of the set of inventory locations with the illumination pattern assigned to the agent. For example, the set of determined inventory locations may be dispersed across two or more inventory areas. In some embodiments, the illumination coordinator may be configured to only direct illumination of the inventory location of the set of the inventory areas without directing illumination of the inventory locations of the set in the other inventory area.

In some embodiments, the agent may be directed to the inventory locations by the particular illumination pattern and may scan the inventory location with the particular illumination pattern such that information associated with the scan (e.g., the inventory location) is sent via the mobile device interface 406 to the control system 414. The control system may determine whether the received information confirms that the scanned location matches one of the locations in the set of locations and send an instruction via the illumination device interface 410 to cease illumination of the illumination device corresponding to the scanned location. In some embodiments, the control system may exchange messages with the data store to store an indication that the operation was performed at the location (e.g., an item was picked or stowed at the location).

Figure 5:
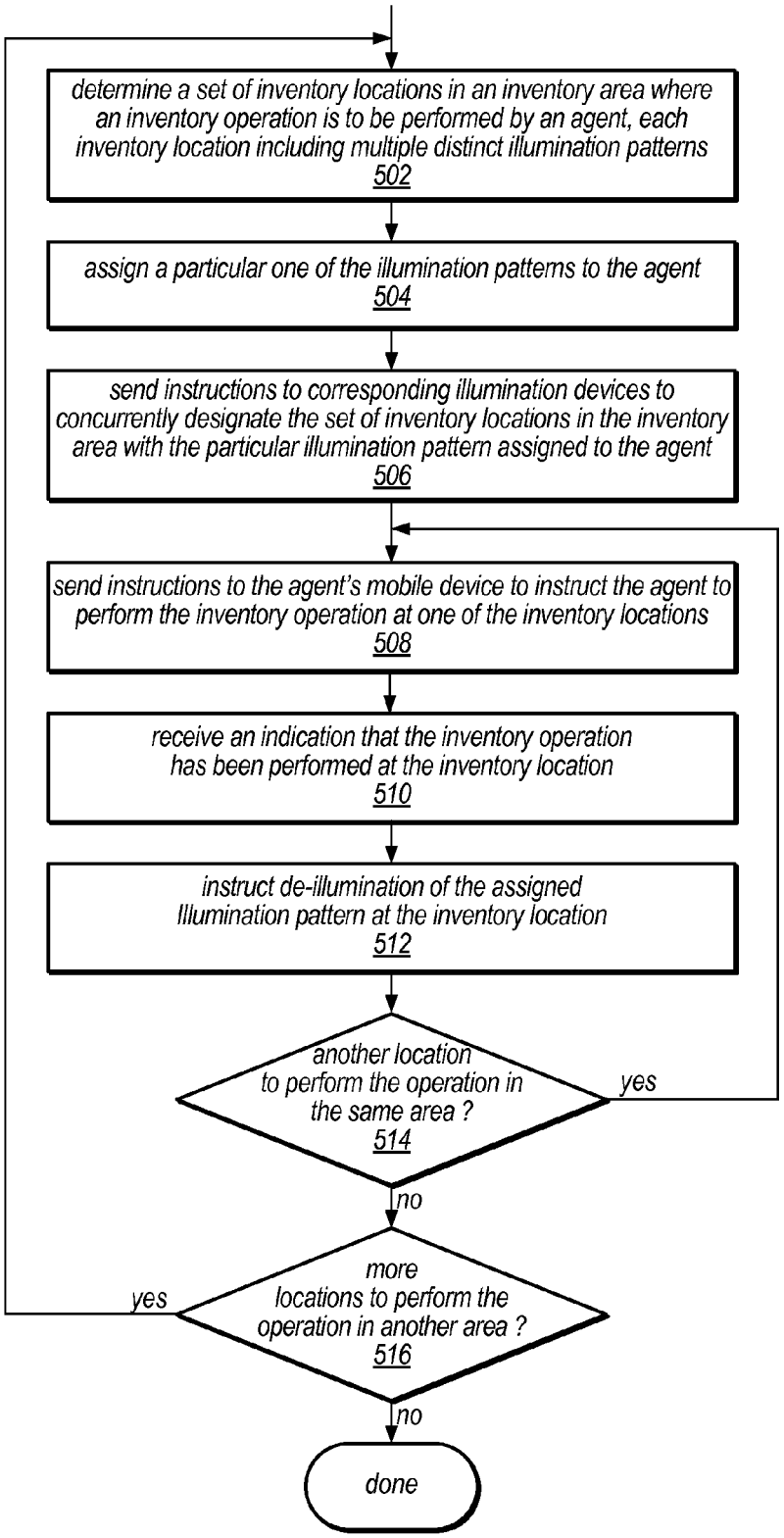
FIG. 5 is a flow diagram of an illumination pattern determination and assignment process according to one embodiment.

In some embodiments, the control system 414 may be configured to perform the process illustrated in FIG. 5 in conjunction with the mobile device system 424 and the illumination system 422, although it is contemplated that other systems may perform the process without departing from the scope of the invention. FIG. 5 illustrates a process of illuminating inventory locations, according to some embodiments. At block 502, a set of inventory locations are determined in an inventory area. In various embodiments, the set of inventory locations may comprise storage bins, storage shelves, locations on a floor and the like. Also at block 502, it is determined that an inventory operation is to be performed at the set of inventory location by an agent and each inventory location includes multiple distinct illumination patterns. As described herein, an inventory operation may be a pick or a stow operation but also may be any other operation that is performed at a facility, such as a packing or stowing operation for example. In some embodiments, the agent path determiner 412 may determine a set of inventory locations in inventory area 235. At block 504, a particular one of the illumination patterns may be assigned to the agent (e.g., one of the patterns of illumination device 108 in FIG. 1). In some embodiments the illumination coordinator 416 may assign an illumination pattern, such as a color or shape or blink rate to an agent, for example. At block 506, instructions may be sent to corresponding illumination devices to concurrently designate the set of inventory locations in the inventory area with the particular illumination pattern assigned to the agent. In some embodiments, illumination coordinator 416 may send instructions via illumination device interface 410 to illumination system 422 instructing the corresponding illumination device to illuminate with the particular illumination pattern assigned to the agent, for example.

At block 508, instructions may be sent to the agent's mobile device to instruct the agent to perform the inventory operation at one of the inventory locations. For example, the control system 414 may send an instruction, via mobile device interface 406, to the agent's mobile device instructing the mobile device to display an instruction directing the agent to perform the operation at the inventory location. In some embodiments, the instruction may be sent to a stationary display in the inventory area. In other embodiments, a paper pick list may be created and provided to the agent. At block 510, an indication may be received that the inventory operation has been performed at the inventory location. In some embodiments, the control system 414 may receive, via mobile device interface 406, the indication. In other embodiments, the illumination device may have a selectable button that determines the indication when selected and sends information associated with the indication to the control system 414.

In some embodiments, the illumination device may be made to change illumination (e.g., blink) when a problem arises. For example, if the illumination device is malfunctioning, or if the agent is unable to find the specified item in the inventory location or if the inventory location or item is missing a bar code to scan. When noticed, such a problem may be input into the illumination device itself via button local to the device or communicated to the control system via communication device such that the control system instructs the illumination system to instruct the illumination device to display a pattern that is recognizable as a trouble code to quality control personnel or repair personnel, for example. Designation of the trouble code may also cause various messages to be sent to various entities to record or resolve the problem.

De-illumination of the assigned illumination pattern at the inventory location may be instructed, as at block 512, for example, by the illumination coordinator via an instruction to the corresponding illumination device via the illumination device interface.

At block 514, a determination whether there is another location to perform the operation in the same area may be made. If there is another location, the process may return to block 508. If there is not another location the process may move to block 516 where a determination whether there are more locations to perform the operation in another area may be made. For example, the set of determined locations may include locations in separate inventory areas. If there are locations in a separate area, the process may return to block 502 and repeat a similar process for that area. If there are not more locations, the process is complete, as indicated by the done block after block 516. In some embodiments, the determinations may be performed by the control system 414 (e.g., agent path determiner 412).

In some embodiments, the process illustrated by FIG. 5 may be repeated for numerous agents. The process may be repeated such that a particular inventory area may be illuminated with distinct illumination patterns such that respective agents are directed to perform operations within the same particular inventory area at the same time. In some embodiments, an illumination device corresponding to a particular inventory location may be illuminated with two or more distinct illumination patterns at the same time to indicate that two different agents are to perform an operation at the same inventory location.

Figure 6:
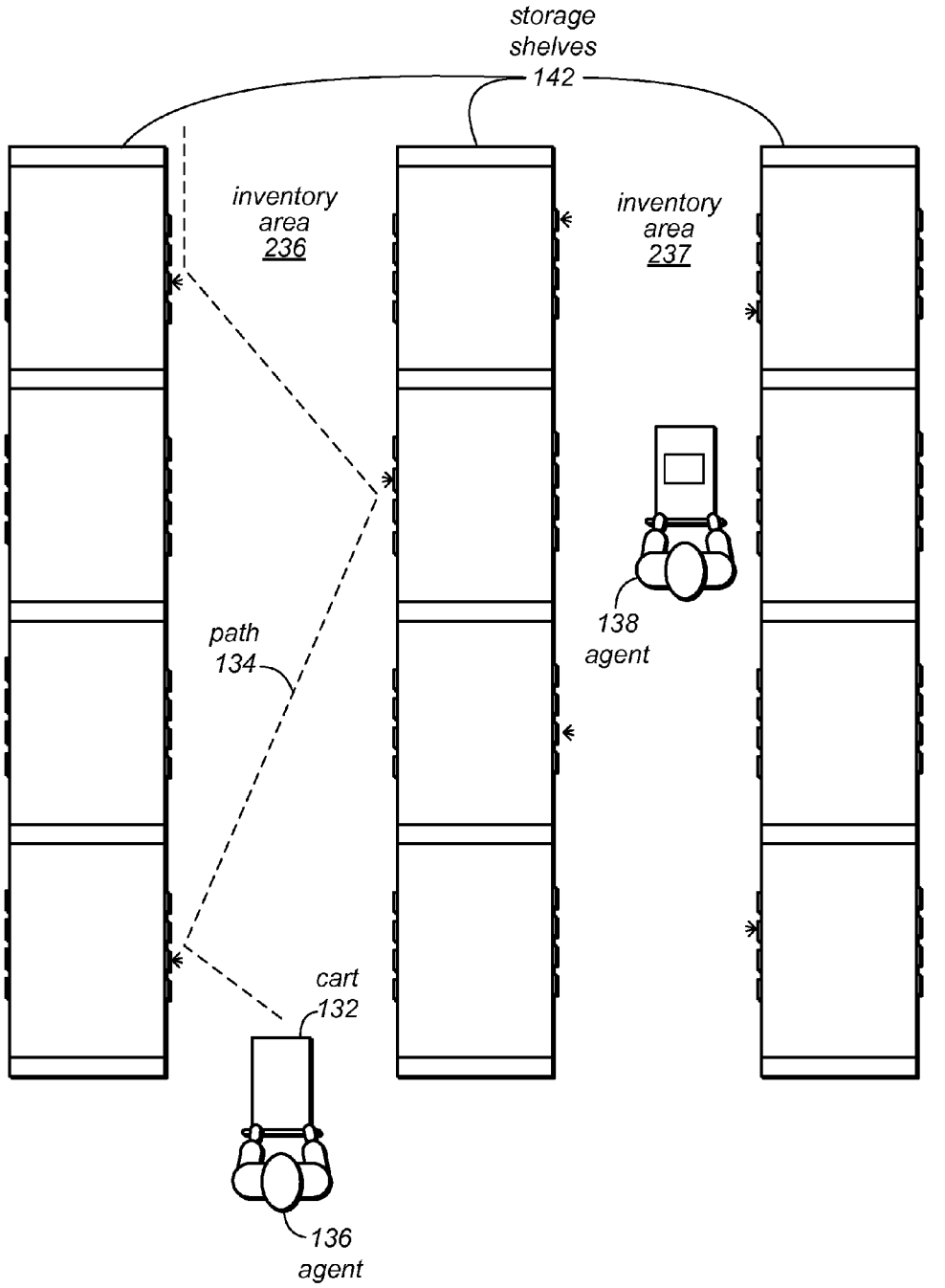
FIG. 6 illustrates a physical layout of storage shelves in an inventory area, according to one embodiment.

FIG. 6 illustrates a facility with multiple inventory areas and agents, including inventory areas (236, 237) and agents (136, 138) navigating aisles between storage selves 142 of inventory, according to some embodiments. Path 134 is illustrated in FIG. 6. In the illustrated embodiment, the path 134 is a perceived path that the agent 136 intends to take to perform operations at the inventory locations that are illuminated. In some facilities, inventory locations may be labeled (e.g., with alpha-numeric labels such as A-22) with labels that may be difficult to read at a distance or at an angle. The addition of illumination to the inventory locations may allow the agent to perceive several inventory locations at once from a distance. The illumination may allow the agent to determine a path between inventory locations more efficiently because several of the inventory locations can be observed at once.

In some embodiments, inventory areas 236 and 237 may be combined into a single inventory area where both agents are operating. For example, in the aisle where agent 138 is operating, an illumination pattern is illuminated for the first inventory location on the right and the second inventory location on the left. Here, FIG. 6 illustrates that agent 138 has passed two illuminated inventory locations (e.g. because agent 138 is assigned to a different illumination pattern—the one that occupies the first location of the illumination device as illustrated in the fourth inventory area to the right of agent 138). In the illustration, agent 136 is assigned to an illumination pattern that shows up as the second location of the illumination device to the left of agent 136. In FIG. 6, the illumination pattern assigned to agent 136 matches the illumination pattern that is illuminated for the first inventory location on the right and the second inventory location on the left of the aisle that agent 138 occupies. FIG. 6 illustrates that illumination of the inventory areas allows agents to determine efficient paths to take when performing operations in the inventory area, in some embodiments.

Figure 7:
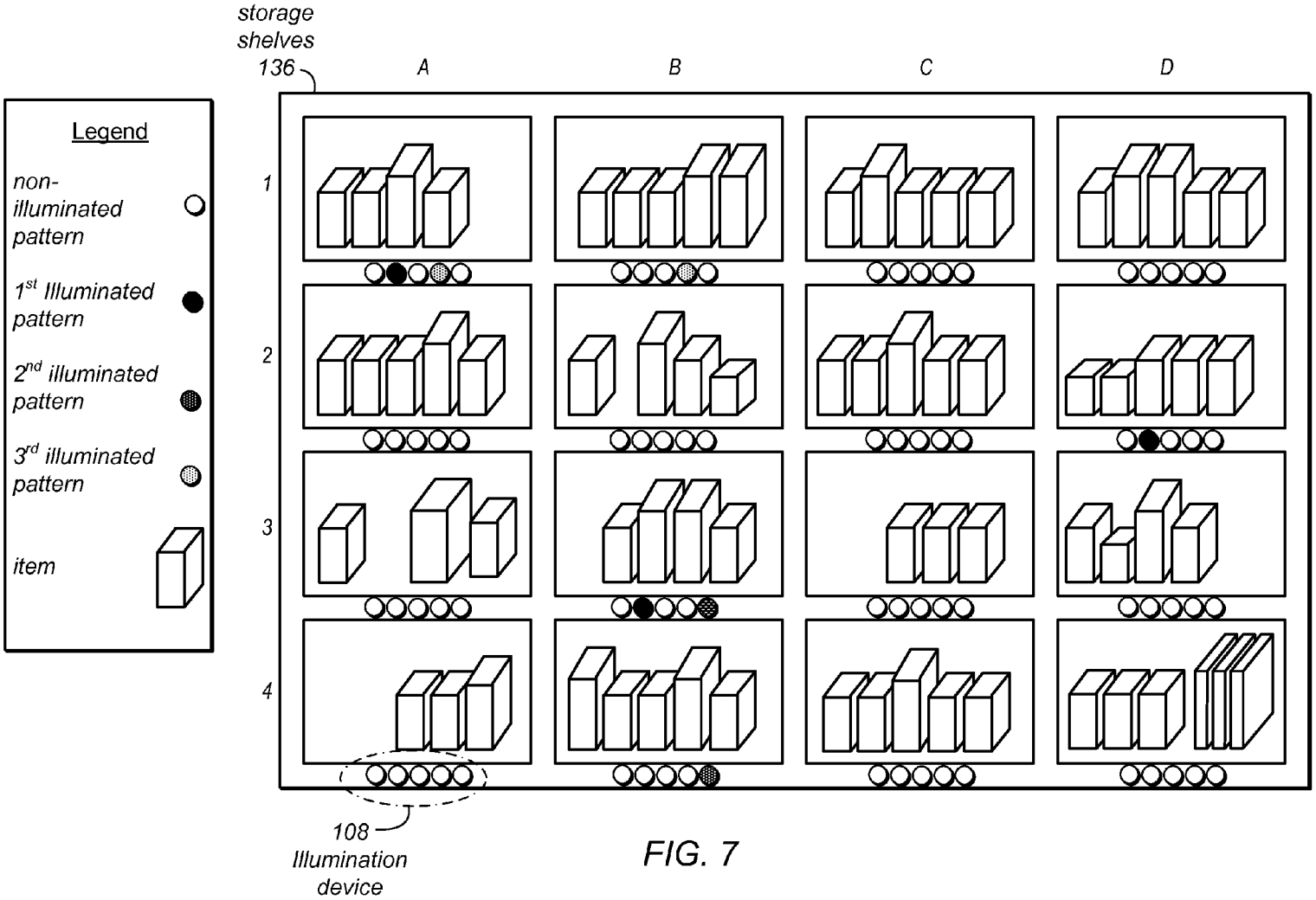
FIG. 7 is a physical layout of a storage shelf, according to different embodiments.

FIG. 7 illustrates twelve inventory locations of an inventory area of storage shelves 136 filled with various items, according to some embodiments. Each inventory location is depicted with a corresponding illumination device (e.g., similar to illumination device 108) composed of five circular patterns that may be illuminated. In the illustration, each inventory area is labeled according to the letter across the top and the numbers along the side. In other embodiments, the illumination devices (e.g., illumination device 108) may include fewer or additional members, different patterns and the inventory area may include fewer or additional inventory locations.

The illumination devices depicted in FIG. 7 differ from the illumination devices of FIG. 1 in that they do not provide any indication of a pattern when they are not illuminated. The members of the illumination devices in FIG. 1 depict members that provide some indication of a pattern even when they are not illuminated (e.g., the lens of the members may be colored even when not illuminated). In some embodiments, the illumination devices 108 may be composed of a configurable display that may be configured to display any combination of color or shape or image such as a display bar with a display screen (e.g., a computer screen or monitor).

FIG. 7 illustrates that any given illumination device may be designated with no illumination, a single illumination pattern or multiple illumination patterns. For example, the illumination device corresponding to inventory location A1 is depicted with two illuminated patterns illuminated (the $1^{st}$ illuminated pattern and the third illuminated pattern as indicated in the legend) while inventory location A2 is depicted without any members of the illumination device illuminated.

Figure 8:
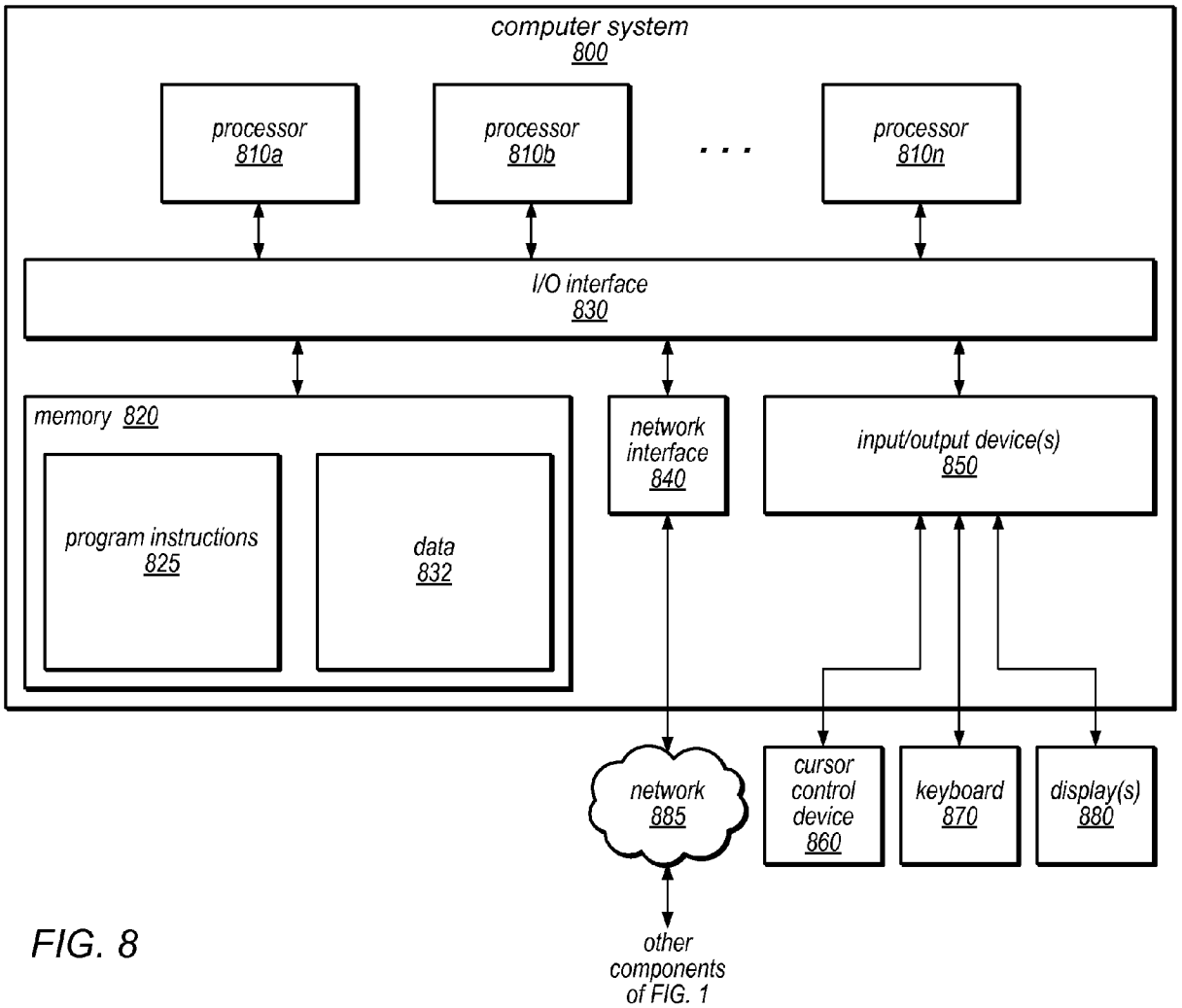
FIG. 8 is a block diagram illustrating a computer system suitable for use in a network-based enterprise, according to one embodiment.

Any of various computer systems may be configured to implement the use of an image-based display system within a materials handling facility. For example, FIG. 8 is a block diagram illustrating one embodiment of a computer system suitable for implementing the system and methods described herein. In various embodiments, an illumination-based control system (e.g., control system 414 of FIG. 4), an order fulfillment center 210, or a communication device (e.g., mobile device 102 illustrated in FIG. 1) may each include a general-purpose computer system such as computer system 800 illustrated in FIG. 8.

In the illustrated embodiment, computer system 800 includes one or more processors 810 coupled to a system memory 820 via an input/output (I/O) interface 830. Computer system 800 further includes a network interface 840 coupled to I/O interface 830. In some embodiments, computer system 800 may be illustrative of control system 414, while in other embodiments control system 414 may include more, fewer, or different elements than computer system 800. In some embodiments, computer system 800 may be illustrative of control system, (e.g., 414), or a communication device (e.g., 102) while in other embodiments a control system or communication device may include more, fewer, or different elements than computer system 800.

In various embodiments, computer system 800 may be a uniprocessor system including one processor 810, or a multiprocessor system including several processors 810 (e.g., two, four, eight, or another suitable number). Processors 810 may be any suitable processors capable of executing instructions. For example, in various embodiments, processors 810 may be general-purpose or embedded processors implementing any of a variety of instruction set architectures (ISAs), such as the x86, PowerPC, SPARC, or MIPS ISAs, or any other suitable ISA. In multiprocessor systems, each of processors 810 may commonly, but not necessarily, implement the same ISA.

System memory 820 may be configured to store instructions and data accessible by processor 810. In various embodiments, system memory 820 may be implemented using any suitable memory technology, such as static random access memory (SRAM), synchronous dynamic RAM (SDRAM), non-volatile/Flash-type memory, or any other type of memory. In the illustrated embodiment, program instructions and data implementing desired functions, such as those methods and techniques described above for an illumination-based control system, or a communication device, are shown stored within system memory 820 as program instructions 825. In some embodiments, system memory 820 may include product database 835, which may be configured as described herein (e.g., data store 402).

In one embodiment, I/O interface 830 may be configured to coordinate I/O traffic between processor 810, system memory 820 and any peripheral devices in the system, including through network interface 840 or other peripheral interfaces. In some embodiments, I/O interface 830 may perform any necessary protocol, timing or other data transformations to convert data signals from one component (e.g., system memory 820) into a format suitable for use by another component (e.g., processor 810). In some embodiments, I/O interface 830 may include support for devices attached through various types of peripheral buses, such as a variant of the Peripheral Component Interconnect (PCI) bus standard or the Universal Serial Bus (USB) standard, for example. In some embodiments, the function of I/O interface 830 may be split into two or more separate components, such as a north bridge and a south bridge, for example. Also, in some embodiments, some or all of the functionality of I/O interface 830, such as an interface to system memory 820, may be incorporated directly into processor 810.

Network interface 840 may be configured to allow data to be exchanged between computer system 800 and other devices attached to a network, such as other computer systems, for example. In particular, network interface 840 may be configured to allow communication between computer system 800 and/or various I/O devices 850. I/O devices 850 may include scanning devices, display devices and/or other communication devices, as described herein. Network interface 840 may commonly support one or more wireless networking protocols (e.g., Wi-Fi/IEEE 802.11, or another wireless networking standard). However, in various embodiments, network interface 840 may support communication via any suitable wired or wireless general data networks, such as other types of Ethernet networks, for example. Additionally, network interface 840 may support communication via telecommunications/telephony networks such as analog voice networks or digital fiber communications networks, via storage area networks such as Fibre Channel SANs, or via any other suitable type of network and/or protocol.

In some embodiments, system memory 820 may be one embodiment of a computer-accessible medium configured to store program instructions and data as described above. However, in other embodiments, program instructions and/or data may be received, sent or stored upon different types of computer-accessible media. Generally speaking, a computer-accessible medium may include computer-readable storage media or memory media such as magnetic or optical media, e.g., disk or DVD/CD-ROM coupled to computer system 800 via I/O interface 830. A computer-readable storage medium may also include any volatile or non-volatile media such as RAM (e.g. SDRAM, DDR SDRAM, RDRAM, SRAM, etc.), ROM, etc, that may be included in some embodiments of computer system 800 as system memory 820 or another type of memory. Further, a computer-accessible medium may include transmission media or signals such as electrical, electromagnetic, or digital signals, conveyed via a communication medium such as a network and/or a wireless link, such as may be implemented via network interface 840.

In some embodiments, I/O devices 850 may be relatively simple or "thin" client devices. For example, I/O devices 850 may be configured as dumb terminals with display, data entry and communications capabilities, but otherwise little computational functionality. However, in some embodiments, I/O devices 850 may be computer systems configured similarly to computer system 800, including one or more processors 810 and various other devices (though in some embodiments, a computer system 800 implementing an I/O device 850 may have somewhat different devices, or different classes of devices).

In various embodiments, I/O devices 850 (e.g., scanners or display devices and other communication devices) may include, but are not limited to, one or more of: handheld devices, devices worn by or attached to the agents, and devices integrated into or mounted on any mobile or fixed equipment of the order fulfillment facility such as pushcarts, bins, totes, racks, shelves, tables, ceilings, walls, and work benches, according to various embodiments. I/O devices 850 may further include, but are not limited to, one or more of: personal computer systems, desktop computers, rack-mounted computers, laptop or notebook computers, workstations, network computers, "dumb" terminals (i.e., computer terminals with little or no integrated processing ability), Personal Digital Assistants (PDAs), mobile phones, or other handheld devices, proprietary devices, printers, or any other devices suitable to communicate with control system 414. In general, an I/O device 850 may be any device that can communicate with control system 414 and convey instructions to agents within the facility. In one embodiment, at least some of the I/O devices 850 may be configured to scan or otherwise read or receive codes or identifiers of various components in the order fulfillment facility and to communicate the entered codes to control system 414 for use in directing agents in the various operations of the control center (e.g., bar code scanners, RFID readers, cameras, or any other sensing devices). Such components may include, but are not limited to, one or more of items, orders, sorting stations, bins, and compartments of bins.

The various methods as illustrated in the figures and described herein represent exemplary embodiments of methods. The methods may be implemented manually, in software, in hardware, or in a combination thereof. The order of any method may be changed, and various elements may be added, reordered, combined, omitted, modified, etc.

Various modifications and changes may be made as would be obvious to a person skilled in the art having the benefit of this disclosure. It is intended to embrace all such modifications and changes and, accordingly, the above description to be regarded in an illustrative rather than a restrictive sense.

What is claimed is:

1. A materials handling facility, comprising:

one or more inventory areas, wherein each inventory area of the one or more inventory areas comprises a plurality of inventory locations for storing inventory items;

a plurality of illumination devices associated with the plurality of inventory locations, wherein the plurality of illumination devices are configured to designate respective inventory locations such that each inventory location of the plurality of inventory locations can be designated with a plurality of distinct illumination patterns;

a control system configured to:

determine a set of the inventory locations in a particular one of the one or more inventory areas, wherein each determined inventory location is an inventory location at which an inventory operation is to be performed by an agent at the particular inventory area;

assign a particular illumination pattern of the plurality of illumination patterns to the agent;

send instructions to a corresponding set of the plurality of illumination devices to concurrently designate all of the inventory locations in the set of the inventory locations at which the inventory operation is to be performed by the agent with the particular illumination pattern assigned to the agent, wherein the concurrent designation visually illustrates locations for the agent to traverse through the particular inventory area to perform the inventory operation;

determine another set of the inventory locations at which an inventory operation is to be performed by another agent at the particular inventory area;

assign another particular illumination pattern of the plurality of illumination patterns to the other agent distinct from the illumination pattern assigned to said agent; and send instructions to a corresponding set of the plurality of illumination devices to concurrently designate all of the other inventory locations in the set of the other inventory locations at which the inventory operation is to be performed by the other agent with the other particular illumination pattern assigned to the other agent.

2. The materials handling facility of claim 1, wherein to designate respective inventory locations with a plurality of distinct illumination patterns, the control system is further configured to designate the particular illumination pattern as one of a particular color, shape or blink rate or particular combination of the color, shape or blink rate.

3. The materials handling facility of claim 1, wherein to determine the other set of the inventory locations at which the inventory operation is to be performed by the other agent at the particular inventory area, the control system is further configured to determine the other set of the inventory locations at which the inventory operation is to be performed by the other agent at the particular inventory area while said agent is still at the particular inventory area.

4. The materials handling facility of claim 1, further comprising:

one or more mobile devices for displaying an indication of at least one inventory location associated with the inventory operation and for scanning item information associated with an items of the at least one inventory location, wherein each mobile device is associated with an agent and configured to:

receive an indication of at least one of the inventory locations of the corresponding set of inventory locations from the control system;

display the indication to an agent; and send item information from a scan by the mobile device to the control system.

5. A method, comprising:

performing, by a control system having a processor and memory:

determining a set of inventory locations in a particular inventory area of a plurality of inventory areas, wherein each determined inventory location is an inventory location at which an inventory operation is to be performed by an agent at the particular inventory area;

assigning a particular illumination pattern of a plurality of distinct illumination patterns to the agent;

sending instructions to a corresponding set of a plurality of illumination devices to concurrently designate a plurality of the inventory locations in the set of the inventory locations at which the inventory operation is to be performed by the agent with the particular illumination pattern assigned to the agent such that the agent is visually aware of locations to traverse through the particular inventory area to perform the inventory operation;

determining another set of the inventory locations at which an inventory operation is to be performed by another agent at the particular inventory area;

assigning another particular illumination pattern of the plurality of illumination patterns to the other agent distinct from the illumination pattern assigned to said agent; and sending instructions to a corresponding set of the plurality of illumination devices to concurrently designate all of the inventory locations in the other set of the inventory locations at which the inventory operation is to be performed by the other agent with the other particular illumination pattern assigned to the other agent.

6. The method of claim 5, further comprising:

selecting, prior to said sending instructions to a corresponding set of the plurality of illumination devices, the particular illumination pattern as one of a particular color, shape or blink rate or particular combination of the color, shape or blink rate.

7. The method of claim 5, wherein said sending instructions to a corresponding set of a plurality of illumination devices is performed in response to detecting that the agent is approaching or has arrived at the particular inventory area.

8. The method of claim 5, further comprising:

receiving an indication that the inventory operation has been performed at one of the designated inventory locations; and sending instructions to modify the particular illumination pattern at a next-closest one of one or more remaining designated inventory locations where the inventory operation has not been performed.

9. The method of claim 5, wherein said determining the other set of the inventory locations at which the inventory operation is to be performed includes determining the other set of the inventory location while said agent is still at the particular inventory area.

10. The method of claim 9, further comprising:

continuing said determining, said assigning and said sending for additional inventory locations and additional agents;

detecting that a number of agents concurrently working in the particular inventory area has reached an illumination pattern threshold; and for an additional agent beyond the illumination pattern threshold to work in the particular inventory area, sending instructions to a mobile device for that agent indicating an inventory location within the particular inventory area for that agent to perform an inventory operation, wherein an illumination pattern is not assigned for that agent.

11. The method of claim 5, further comprising:

sending instructions to a mobile device associated with the agent to display an indication of at least one of the inventory locations of the set such that the agent is directed to perform the inventory operation at that inventory location;

receiving information from the mobile device confirming that the inventory operation was performed at that inventory location; and in response to said receiving, sending instructions to the illumination device associated with that inventory location to cease illuminating the particular illumination pattern assigned to the agent at that inventory location.

12. The method of claim 5, further comprising:

sending instructions to a mobile device associated with the agent to display an indication of at least one of the inventory locations of the set such that the agent is directed to perform the inventory operation at that inventory location; and wherein the instructions include instructions to illuminate, on the mobile device, an illumination pattern matching the particular illumination pattern assigned to the agent.

13. A non-transitory computer-readable medium storing program instructions that when executed by a computer system perform:

determining a set of inventory locations in a particular one of a plurality of inventory areas, wherein each determined inventory location is an inventory location at which an inventory operation is to be performed by an agent at the particular inventory area;

assigning a particular illumination pattern of a plurality of illumination patterns to the agent;

sending instructions to a corresponding set of a plurality of illumination devices to concurrently designate a plurality of the inventory locations in the set of the inventory locations at which the inventory operation is to be performed by the agent with the particular illumination pattern assigned to the agent such that the agent is visually aware of locations to traverse through the particular inventory area to perform the inventory operation;

determining another set of the inventory locations at which an inventory operation is to be performed by another agent at the particular inventory area;

assigning another particular illumination pattern of the plurality of illumination patterns to the other agent distinct from the illumination pattern assigned to said agent; and sending instructions to a corresponding set of the plurality of illumination devices to concurrently designate all of the inventory locations in the other set of the inventory locations at which the inventory operation is to be performed by the other agent with the other particular illumination pattern assigned to the other agent.

14. The non-transitory computer-readable medium of claim 13, wherein the program instructions are further executable to perform:

selecting, prior to said sending instructions to a corresponding set of a plurality of illumination devices, the particular illumination pattern as one of a particular color, shape or blink rate or particular combination of the color, shape or blink rate.

15. The non-transitory computer-readable medium of claim 14, wherein said sending instructions to a corresponding set of a plurality of illumination devices is performed in response to detecting that the agent is approaching or has arrived at the particular inventory area.

16. The non-transitory computer-readable medium of claim 13, wherein the program instructions are further executable to perform:

receiving an indication that the inventory operation has been performed at one of the designated inventory locations; and sending instructions to modify the particular illumination pattern at a next-closest one of one or more remaining designated inventory locations where the inventory operation has not been performed.

17. The non-transitory computer-readable medium of claim 13, wherein to perform said determining the other set of the inventory locations at which the inventory operation is to be performed the program instructions are further executable to perform:

determining the other set of the inventory locations at which the inventory operation is to be performed by the other agent at the particular inventory area while said agent is still at the particular inventory area.

18. The non-transitory computer-readable medium of claim 17, wherein the program instructions are further executable to perform:

continuing said determining, said assigning and said sending for additional inventory locations and additional agents until an illumination pattern threshold is met, wherein the illumination pattern threshold is a maximum number of illumination patterns;

defaulting, subsequent to meeting the threshold, to said determining without performing said assigning or said sending; and allocating each of the determined sets of inventory locations that were determined without performing said assigning or said sending to respective additional agents.

19. The non-transitory computer-readable medium of claim 13, wherein the program instructions are further executable to perform:

determining another set of inventory locations in another one of the inventory areas separate from the particular inventory area;

assigning another agent to perform an inventory operation at the other set of inventory locations in the other inventory area; and assigning the particular illumination pattern of the plurality of illumination patterns to both the set of inventory locations and the another set of inventory locations such that the respective agent and other agent are both directed by the particular illumination pattern but in separate, non-overlapping inventory area.

20. The non-transitory computer-readable medium of claim 13, wherein the inventory operation is either a stow operation or a pick operation associated with an item; and wherein the program instructions are further executable to perform:

instructing a mobile device to display an instruction to perform the stow operation or the pick operation for at least one of the inventory locations of the set such that an agent is directed to perform the inventory operation;

receiving from the mobile device information from a scan performed by the mobile device; and confirming from analysis of the received information that the inventory operation was performed at the inventory location.

* * * * *